US005126138A

United States Patent [19]

McGee et al.

[11] Patent Number: 5,126,138

[45] Date of Patent: Jun. 30, 1992

[54] ANTIMICROBIAL FLOUROCHEMICALLY TREATED PLASTIC (NYLON) SURFACES

[75] Inventors: James B. McGee, Sanford, Mich.; Kelly L. Benjamin, Pinellas Park, Fla.

[73] Assignee: Dow Corning Corporation, Midland, Mich.

[21] Appl. No.: 221,851

[22] Filed: Jul. 19, 1988

[51] Int. Cl.[5] ..... A01N 25/34; C08J 7/14

[52] U.S. Cl. ..... 424/404; 424/405

[58] Field of Search ..... 523/122; 424/405, 404, 424/403; 428/288

[56] References Cited

U.S. PATENT DOCUMENTS

| | | | |
|---|---|---|---|
| 3,560,385 | 2/1971 | Roth | 252/49.6 |
| 3,730,701 | 5/1973 | Isquith et al. | 71/67 |
| 3,794,736 | 2/1974 | Abbott et al. | 424/78 |
| 3,817,739 | 6/1974 | Abbott et al. | 71/67 |
| 3,824,126 | 7/1974 | Katsushima | 117/139.5 |
| 3,835,148 | 9/1974 | Oxe et al. | 524/579 |
| 3,860,709 | 1/1975 | Abbott et al. | 424/184 |
| 3,865,728 | 2/1975 | Abbott et al. | 210/169 |
| 4,034,079 | 7/1977 | Schoonman | 424/83 |
| 4,076,631 | 2/1978 | Caruso et al. | 428/96 |
| 4,084,747 | 4/1978 | Alliger et al. | 422/20 |
| 4,259,103 | 3/1981 | Malek et al. | 71/67 |
| 4,282,366 | 8/1981 | Eudy | 556/413 |
| 4,371,577 | 2/1983 | Sato et al. | 428/96 |
| 4,394,378 | 7/1983 | Klein | 424/184 |
| 4,395,454 | 7/1983 | Baldwin | 428/290 |
| 4,406,892 | 9/1983 | Eudy | 424/184 |
| 4,408,996 | 10/1983 | Baldwin | 8/490 |
| 4,411,928 | 10/1983 | Baldwin | 427/2 |
| 4,414,268 | 11/1983 | Baldwin | 428/289 |
| 4,425,372 | 1/1984 | Baldwin | 427/2 |
| 4,467,013 | 8/1984 | Baldwin | 428/289 |
| 4,504,541 | 3/1985 | Yasuda et al. | 428/264 |
| 4,615,937 | 10/1986 | Bouchette | 428/288 |
| 4,631,297 | 12/1986 | Battice et al. | 521/78 |
| 4,692,374 | 9/1987 | Bouchette | 428/288 |
| 4,721,511 | 1/1988 | Kupits | 424/404 |
| 4,737,405 | 4/1988 | Bouchette | 428/288 |
| 4,740,398 | 4/1988 | Bouchette | 428/28 |
| 4,781,974 | 11/1988 | Bouchette et al. | 428/288 |
| 4,822,667 | 4/1989 | Goad et al. | 428/225 |

FOREIGN PATENT DOCUMENTS

| | | |
|---|---|---|
| 156809 | 3/1985 | Japan . |
| 61-000680 | 1/1986 | Japan . |
| 8601457 | 1/1987 | PCT Int'l Appl. . |
| 1386876 | 3/1975 | United Kingdom . |
| 1433303 | 4/1976 | United Kingdom . |

*Primary Examiner*—Thurman K. Page
*Assistant Examiner*—Neil S. Levy
*Attorney, Agent, or Firm*—Jim L. DeCesare

[57] ABSTRACT

A method of making the surface of a fluorochemically treated substrate antimicrobially active by exposing the fluorochemically treated substrate to a compound selected from the group consisting of inorganic acids and organic acids. Exemplary of the acids are sulfuric, hydrofluoric, hydrochloric, hydrobromic, hydriodic, nitric, perchloric, phosphoric, boric, acetic, adipic, anisic, benzoic, butyric, fumaric, gallic, glutaric, glycolic, lactic, lauric, tannic, and tartaric acids.

6 Claims, No Drawings

ANTIMICROBIAL FLOUROCHEMICALLY TREATED PLASTIC (NYLON) SURFACES

BACKGROUND OF THE INVENTION

This invention is directed to a method for producing on the surface of a fluorochemically treated substrate an antimicrobially active surface by exposing the substrate to a strong acid.

Antimicrobial agents are chemical compositions that are used to prevent microbiological contamination and deterioration of products, materials, and systems. Particular areas of application of antimicrobial agents and compositions are, for example, cosmetics, disinfectants, sanitizers, wood preservation, food, animal feed, cooling water, metalworking fluids, hospital and medical uses, plastics and resins, petroleum, pulp and paper, textiles, latex, adhesives, leather and hides, and paint slurries. Of the diverse categories of antimicrobial agents and compositions, quaternary ammonium compounds represent one of the largest of the classes of antimicrobial agents in use. At low concentrations, quaternary ammonium type antimicrobial agents are bacteriostatic, fungistatic, algistatic, sporostatic, and tuberculostatic. At medium concentrations they are bactericidal, fungicidal, algicidal, and viricidal against lipophilic viruses. Silicone quaternary ammonium salt compounds are well known as exemplified by U.S. Pat. No. 3,560,385, issued Feb. 2, 1971, and the use of such compounds as antimicrobial agents is taught, for example, in a wide variety of patents such as U.S. Pat. Nos. 3,730,701, issued May 1, 1973, and 3,817,739, issued Jun. 18, 1974, where the compounds are used to inhibit algae; 3,794,736, issued Feb. 26, 1974, and 3,860,709, issued Jan. 14, 1975, where they are employed for sterilizing or disinfecting a variety of surfaces and instruments; 3,865,728, issued Feb. 11, 1975, where the compounds are used to treat aquarium filters; 4,259,103, issued Mar. 31, 1981; and in British Patent No. 1,386,876, of Mar. 12, 1975. Published unexamined European Application No. 228464 of Jul. 15, 1987, teaches that microorganisms on plants can be killed by the application thereto of an aqueous mixture of a surfactant and an organosilicon quaternary ammonium compound. In a particular application of an antimicrobial silicone quaternary ammonium compound, a paper substrate is rendered resistant to the growth of microorganisms in U.S. Pat. No. 4,282,366, issued Aug. 4, 1981. In U.S. Pat. No. 4,504,541, issued Mar. 12, 1985, an antimicrobial fabric is disclosed which is resistant to discoloration and yellowing by treatment of the fabric with a quaternary ammonium base containing an organosilicone. U.S. Pat. No. 4,615,937, issued Oct. 7, 1986, as well as its companion U.S. Pat. No. 4,692,374, issued Sep. 8, 1987, relate to wet wiper towelettes having an antimicrobial agent substantive to the fibers of the web and being an organosilicon quaternary ammonium compound. In a series of Burlington Industries, Inc. U.S. Pat. Nos. 4,408,996, issued Oct. 11, 1983, 4,414,268, issued Nov. 8, 1983, 4,425,372, issued Jan. 10, 1984, and 4,395,454, issued Jul. 26, 1983, such compounds are disclosed to be useful in surgical drapes, dressings, and bandages. This same assignee also discloses these compounds as being employed in surgeons' gowns in U.S. Pat. Nos. 4,411,928, issued Oct. 25, 1983, and 4,467,013, issued Aug. 21, 1984. Organosilicon quaternary ammonium compounds have been employed in carpets, in U.S. Pat. No. 4,371,577, issued Feb. 1, 1983; applied to walls, added to paints, and sprayed into shoes, in U.S. Pat. No. 4,394,378, issued Jul. 19, 1983; applied to polyethylene surfaces and used in pillow ticking in U.S. Pat. No. 4,721,511, issued Jan. 26, 1988; in flexible polyurethane foams of fine-celled, soft, resilient articles of manufacture in U.S. Pat. No. 4,631,297, issued Dec. 23, 1986; and mixed with a surfactant in Japanese Kokai Application No. 58-156809, filed Aug. 26, 1983, of Sanyo Chemical Industries, Ltd., for the purpose of achieving uniformity of distribution of the compounds to a surface.

The antimicrobial agents described above are effective and versatile. However, their chemistry is complex. In the present invention, a simple approach is provided and an alternative to the previous complex techniques of the prior art.

It is not new to employ an acid to kill germs. For example, in copending U.S. patent application Ser. No. 187,151, filed Apr. 28, 1988, of Lynne Marie Blehm Blank, and assigned to the same assignee as the present application, acids are combined with quaternary ammonium compounds of the type above referenced, in order to provide a synergistic effect in combatting microorganisms. U.S. Pat. No. 4,034,079, issued Jul. 5, 1977, is representative of the use of boric acid. Lactic acid is taught in U.S. Pat. No. 4,084,747, issued Apr. 18, 1978, as a germ killing composition. In U.S. Pat. No. 4,737,405, issued Apr. 12, 1988, and in its companion U.S. Pat. No. 4,740,398, issued Apr. 26, 1988, there is disclosed leachable antimicrobial agents of acids such as citric, malic, sorbic, and ethylenediaminetetra-acetic acid. What has not been taught by the prior art and the concept of the present invention, is to employ strong acids to treat a particular type of substrate, the substrate having previously been fluorochemically exposed. Thus, in accordance with the present invention, a fluorochemically treated substrate is boiled in sulfuric acid thereby rendering a surface of the substrate antimicrobially active. This new and simple technique is not disclosed in the prior art.

SUMMARY OF THE INVENTION

This invention relates to a method of inhibiting the proliferation of potentially destructive microorganisms on a substrate that has been treated with a fluorochemical by exposing the fluorochemically treated substrate to a compound selected from the group consisting of inorganic acids and organic acids.

This invention also relates to a method of rendering a fluorochemically treated surface of a substrate antimicrobially active by exposing the surface of the fluorochemically treated substrate to an inorganic acid selected from the group consisting of sulfuric, hydrofluoric, hydrochloric, hydrobromic, hydriodic, nitric, perchloric, fluorosulfuric, trifluoromethylsulfonic, phosphoric, sulfurous, boric, hydrosulfuric, hydrocyanic, hypochlorous, hypoiodus, nitrous, chlorous, iodous, phosphorous, chloric, iodic, and periodic acids. In a preferred embodiment, the substrate is a polyamide plastic and the acid is sulfuric acid. In an even more preferred embodiment, the polyamide plastic is nylon and the nylon is exposed to sulfuric acid by boiling the nylon in the sulfuric acid.

The invention further relates to a material for inhibiting the proliferation of potentially destructive microorganisms on a surface thereof, the material being a fluorochemically treated substrate which has been exposed to an organic acid selected from the group consisting of acetic, adipic, anisic, benzoic, butyric, capric, citraconic, citric, cresotinic, elaidic, formic, fumaric, gallic, glutaric, glycolic, lactic, lauric, levulinic, maleic, malic, malonic, oleic, oxalic, palmitic, phthalic, propionic, pyruvic, salicylic, stearic, succinic, tannic, and tartaric acids.

It is therefore an object of the present invention to provide a new type of antimicrobially active surface produced by a simple process of boiling fluorochemically treated substrates in a strong acid.

These and other objects, features, and advantages, of the present invention will become apparent when considered in light of the following detailed description of the invention.

DETAILED DESCRIPTION OF THE INVENTION

Ammonium compounds in which all of the hydrogen atoms have been substituted by alkyl groups are called quaternary ammonium salts. These compounds may be represented in a general sense by the formula:

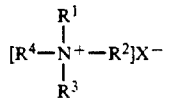

The nitrogen atom includes four covalently bonded substituents that provide a cationic charge. The R groups can be any organic substituent that provides for a carbon and nitrogen bond with similar and dissimilar R groups. The counterion X is typically halogen. Use of quaternary ammonium compounds is based on the lipophilic portion of the molecule which bears a positive charge. Since most surfaces are negatively charged, solutions of these cationic surface active agents are readily adsorbed to the negatively charged surface. This affinity for negatively charged surfaces is exhibited by 3-(trimethoxysilyl)propyldimethyloctadecyl ammonium chloride of the formula:

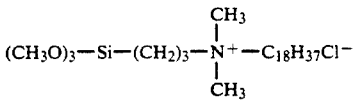

In the presence of moisture, this antimicrobial agent imparts a durable, wash resistant, broad spectrum biostatic surface antimicrobial finish to a substrate. The organosilicon quaternary ammonium compound is leach resistant, nonmigrating, and is not consumed by microorganisms. It is effective against gram positive and gram negative bacteria, fungi algae, yeasts, mold, rot, mildew, and malodor. The silicone quaternary ammonium salt provides durable, bacteriostatic, fungistatic, and algistatic surfaces. It can be applied to organic or inorganic surfaces as a dilute aqueous solution 0.1–1.5 percent by weight of active ingredient. After the alkoxysilane is applied to a surface, it is chemically bonded to the substrate by condensation of the silanol groups at the surface. The compound is a low viscosity, light to dark amber liquid, soluble in water, alcohols, ketones, esters, hydrocarbons, and chlorinated hydrocarbons. The compound has been used in applications such as, for example, socks, filtration media, bed sheets, blankets, bedspreads, carpet, draperies, fire hose fabric materials, humidifier belts, mattress pads, mattress ticking, underwear, nonwoven disposable diapers, nonwoven fabrics, outerwear fabrics, nylon hosiery, vinyl paper, wallpaper, polyurethane cushions, roofing materials, sand bags, tents, tarpaulins, sails, rope, athletic and casual shoes, shoe insoles, shower curtains, toilet tanks, toilet seat covers, throw rugs, towels, umbrellas, upholstery, fiberfill, intimate apparel, wiping cloths, and medical devices.

The complexity of the prior art should therefore be apparent, and the concept of the present invention presents a viable and more simple approach to the problem of inhibiting contamination by microorganisms. The surfaces produced by the techniques of the present invention can be substituted for those surfaces generated by the complex prior art techniques, and in similar areas of application.

Fluorochemicals are applied to fibers of various compositions in order to render such fibers oil, water, alcohol, and soil repellent. It is not uncommon to incorporate antimicrobial agents in such processes in order to further protect the fibers from such undesirable characteristics as odor, deterioration, and defacement by microbes. The addition of such antimicrobial agents complicate fiber manufacture in that specialized dye procedures must be employed, as well as specialized handling and finishing procedures. Such specialized procedures are sought to be avoided in accordance with the present invention, and what is provided is a method wherein fluorochemically treated surfaces can be modified in order to provide the finished goods with an antimicrobial characteristic but without the necessity of employing complex antimicrobial agents. By simply exposing fluorochemically treated nylon, for example, to a strong acid by boiling the nylon in dilute sulfuric acid, the surface of the nylon is chemically modified and rendered antimicrobially active.

The substrate having the fluorochemically treated surface can include any plastic material, and while the present invention is specific to polyamides, any plastic material may be substituted therefore. Exemplary plastic materials intended to be included within the scope of the present invention are, for example, acetals; acrylics such as polymethylmethacrylate and polyacrylonitrile; alkyds; alloys such as acrylic-polyvinylchloride, acrylonitrile-butadiene-styrene-polyvinylchloride, acrylonitrile-butadiene-styrene-polycarbonate; allyls such as allyl-diglycol-carbonate and diallyl-phthalate; cellulosics such as cellulose acetate, cellulose acetate propionate, cellulose acetate butyrate, cellulose nitrate, ethyl cellulose, and rayon; chlorinated polyethers; epoxies; fluorocarbons such as polytetrafluoroethylene, polychlorotrifluoroethylene, perfluoroalkoxies, fluorinated ethylene-propylene, polyvinylidene fluoride, ethylene-chlorotrifluoroethylene, ethylene-tetrafluoroethylene and polyvinylfluoride; melamine formaldehyde; melamine phenolics; nitriles; phenolics; polyamides such as Nylon 6, Nylon 6/6, Nylon 6/9, Nylon 6/12, Nylon 11, Nylon 12 and aromatic nylons; polyamide-imides; polyarylethers; polycarbonates; polyesters such as polybutylene terephthalate, polyethylene terephthlate, unsaturated polyesters as butadiene-maleic acid and styrene-maleic acid; polyimides; polymethylpentene; polyolefins such as polyethylene, polypropylene, polybutylene and polyallomers; polyphenylene oxides; polyphenylene sulfides; polyurethanes; silicones; styrenics such as polystyrene, acrylonitrile-butadiene-styrene, styrene-acrylonitrile and styrene-butadiene; sulfones such as polysulfone, polyether sulfone and polyphenyl sulfone; thermoplastic elastomers such as polyolefins, polyesters and block copolymers as styrene-butadiene, styrene-isoprene, styrene-ethylene, and styrene-butylene; urea formaldehyde; and vinyls such as polyvinyl chloride, polyvinyl acetate, polyvinylidene chloride, polyvinyl butyrate and polyvinyl alcohol.

A strong acid is preferred for the boiling treatment and such acid may include an inorganic acid such as sulfuric, hydrofluoric, hydrochloric, hydrobromic, hydriodic, nitric, perchloric, fluorosulfuric, trifluoromethylsulfonic, phosphoric, sulfurous, boric, hydrosulfuric, hydrocyanic, hypochlorous, hypoiodus, nitrous, chlorous, iodous, phosphorous, chloric, iodic, and periodic acids, or an organic acid such as acetic, adipic, anisic, benzoic, butyric, capric, citraconic, citric, cresotinic, elaidic, formic, fumaric, gallic, glutaric, glycolic, lactic, lauric, levulinic, maleic, malic, malonic, oleic, oxalic, palmitic, phthalic, propionic, pyruvic, salicylic, stearic, succinic, tannic, and tartaric acids.

In the fabric industry, it becomes necessary to fluorochemically treat certain substrates in order to impart to the substrate enhanced characteristics. For example, repellency is a desired property for many fabrics. It is not uncommon to use a treatment bath in such instances.

If alcohol and water repellency are desired properties of the fabric, then the bath preferably comprises a fluorocarbon repellent with an optional fluorocarbon extender. The fluorocarbon repellent component is typically a dispersion of fluoropolymer in water. The fluorocarbon repellent component may be selected from a host of commercially available products including 3M's FC-824, FC-831, and FC-461 and DuPont's Zepel K, Zepel RN, Zepel RS, and Zonyl NWF. One will select a fluorocarbon component that is compatible with the system, other bath components and processing conditions, is economical, and provides the required alcohol repellency. As the fluorocarbon component is more expensive than the wax/resin fluorocarbon extender described below, it is desirable to use the smallest amount of the more expensive component as possible.

The wax/resin component is well known in the art as a fluorocarbon extender. These materials are typically available in emulsions with a cationic or nonionic emulsifier. Suitable wax/resin fluorocarbon extenders commercially available include: Aerotex Repellent 96, a water dispersible wax resin containing reactive nitrogenous compounds available from American Cyanamid; Norane 193, a high molecular weight hydrophobic resin wax complex, and Norane 88, both available from Sun Chemical Company; and Nalan W, a thermosetting resin condensate, and Nalan GN, a polymer wax dispersion, both available from DuPont. The wax/resin extender provides the finished fabric with the water repellency desired, and of course, allows for a reduction in the amount of the more expensive fluorocarbon repellent component.

When a fluorocarbon repellent component is added to the bath, other materials besides the fluorocarbon extender, such as sodium acetate, citric acid, Avitex 2153 obtained from DuPont, or Synthrapol KB, obtained from DuPont, can be added to the bath in order to stabilize the bath.

It is the foregoing types of fluorochemically treated substrates to which the present invention is aimed.

The examples are set forth in order to illustrate the concepts and precepts of the present invention, and in each example, the percent reduction was determined in accordance with the following procedure.

The antimicrobial activity of a treated surface is evaluated by shaking a sample weighing 0.75 grams in a 750,000 to 1,500,000 count *Klebsiella pneumoniae* suspension for a one hour contact time. The suspension is serially diluted, both before and after contact, and cultured. The number of viable organisms in the suspensions is determined. The percent reduction based on the original count is determined. The method is intended for those surfaces having a reduction capability of 75 to 100% for the specified contact time. The results are reported as the percent reduction.

Media used in this test are nutrient broth, catalog No. 0003-01-6 and tryptone glucose extract agar, catalog No. 0002-01-7 both available from Difco Laboratories, Detroit, Mich., U.S.A. The microorganism used is *Klebsiella pneumoniae* American Type Culture Collection; Rockville, Md. U.S.A., catalog No. 4352.

The procedure used for determining the zero contact time counts is carried out by utilizing two sterile 250 ml. screw-cap Erlenmeyer flasks for each sample. To each flask is added 70 ml of sterile buffer solution. To each flask is added, aseptically, 5 ml of the organism inoculum. The flasks are capped and placed on a wrist action shaker. They are shaken at maximum speed for 1 minute. Each flask is considered to be at zero contact time and is immediately subsampled by transferring 1 ml of each solution to a separate test tube containing 9 ml of sterile buffer. The tubes are agitated with a vortex mixer and then 1 ml of each solution is transferred to a second test tube containing 9 ml of sterile buffer. Then, after agitation of the tubes, 1 ml of each tube is transferred to a separate sterile petri dish. Duplicates are also prepared. Sixteen ml of molten (42° C.) tryptone glucose extract agar is added to each dish. The dishes are each rotated ten times clockwise and ten times counterclockwise. The dishes are then incubated at 37° C. for 24 to 36 hours. The colonies are counted considering only those between 30 and 300 count as significant. Duplicate samples are averaged. The procedure used for determining the bacterial count after 1 hour is essentially the same as that used to determine the count at the zero contact time. The only difference is that pour plating is performed at the $10^0$ and $10^{-1}$ dilutions as well as at the $10^{-2}$ dilution. "Percent reduction" is calculated by the formula $$\% R = \frac{\frac{B+C}{2} - A \; 100}{\frac{B+C}{2}}$$

where A is the count per milliliter for the flask containing the treated substrate; B is zero contact time count per milliliter for the flask used to determine "A" before the addition of the treated substrate and C is zero contact time count per milliliter for the untreated control substrate.

The microbiological efficacy of samples treated by the method of the present invention was determined as noted above. The antimicrobial activity of these treated surfaces was evaluated by shaking samples in *Klebsiella pneumoniae* suspension for a one hour contact time. The suspension was serially diluted both before and after contact and cultured. The number of viable organisms in the suspensions was determined. The percent reduction based on the original count was also determined.

The results of the antimicrobial activity dynamic surface testing indicated that the treated surfaces were antimicrobially active in their nature and function, and the microorganisms were substantially reduced in number. Accordingly, the antimicrobial activity of the treated surfaces of the present invention was rated excellent.

EXAMPLE I

ANSO® IV fiber, a Nylon 6 fluorochemically treated fiber manufactured by Allied Chemical Corporation-Fibers Division, Morristown, N.J., and a trademark of that company, was tested for its antimicrobial activity in accordance with the procedure outlined above. The fiber was then boiled for one hour in sulfuric acid of varied concentrations in five hundred milliliters of tap water. Each sample was then tested for its antimicrobial activity in accordance with the above described procedure. The results are tabulated in Table I.

TABLE I

| SAMPLE | PERCENT REDUCTION |
|---|---|
| Untreated | 16.0 |
| One drop of acid | 14.0 |
| Two drops of acid | 99.8 |
| Three drops of acid | 99.9 |

EXAMPLE II

The procedure of Example I was repeated except that the samples used were not fluorochemically treated nylon but samples of undyed Nylon 6 and Nylon 6/6. Sulfuric acid was used and three drops of acid were added to five hundred milliliters of tap water in each instance, and the sample acid boiled. The data from such tests are set forth in Table II, and it will be apparent that without the fluorochemical fiber treatment of the fiber of Example I, no substantial reduction can be obtained.

TABLE II

| SAMPLE | PERCENT REDUCTION |
|---|---|
| Untreated Nylon 6/6 | 8.0 |
| Boiled Nylon 6/6 | 8.0 |
| Untreated Nylon 6 | 10.0 |
| Boiled Nylon 6 | 10.0 |

EXAMPLE III

Example II was repeated except that two fluorochemically treated fibers were employed, one fiber being the fiber used in Example I, and the second fiber being ANTRON®, a Nylon 6/6 fluorochemically treated fiber manufactured by Du Pont de Nemours, E. I. & Company, Wilmington, Del., and a trademark of that company. Three drops of sulfuric acid in five hundred milliliters of tap water was again used for boiling the fibers, and the data for the treated and untreated samples are set forth in Table III.

TABLE III

| SAMPLE | PERCENT REDUCTION |
|---|---|
| Untreated ANTRON ® | 14.0 |
| Boiled ANTRON ® | 97.0 |
| Untreated ANSO ® IV | 42.0 |
| Boiled ANSO ® IV | 98.0 |

The foregoing examples, tests, and Tables, show the efficacy of the treatment method of the present invention, and illustrate the antimicrobially active surface produced on substrates of fluorochemically treated fibers. Such substrates may be modified in accordance with the present invention during the fiber manufacture, or at anytime during subsequent treatment of the textile.

It will be apparent from the foregoing that many other variations and modifications may be made in the structures, compounds, compositions, and methods described herein without departing substantially from the essential concepts of the present invention. Accordingly, it should be clearly understood that the forms of the invention described herein are exemplary only and are not intended as limitations on the scope of the present invention.

That which is claimed is:

1. A material for inhibiting the proliferation of potentially destructive microorganisms on a surface thereof comprising a fluorochemically treated plastic substrate which has been boiled in a compound selected from the group consisting of inorganic acids and organic acids for a period of time sufficient to chemically modify and render a surface of the plastic substrate antimicrobially active.

2. The material of claim 1 wherein the plastic substrate is a polyamide plastic and the acid is sulfuric acid.

3. The material of claim 2 wherein the polyamide plastic is nylon.

4. The method of inhibiting the proliferation of potentially destructive microorganisms on a plastic substrate comprising treating the plastic substrate with a fluorochemical, boiling the fluorochemically treated plastic substrate in a compound selected from the group consisting of inorganic acids and organic acids for a period of time sufficient to chemically modify and render a surface of the plastic substrate antimicrobially active, and contacting the microorganisms therewith.

5. The method of claim 4 wherein the plastic substrate is a polyamide plastic and the acid is sulfuric acid.

6. The method of claim 5 wherein the polyamide plastic is nylon.

* * * * *